US007811164B1

(12) United States Patent
Fox

(10) Patent No.: US 7,811,164 B1
(45) Date of Patent: Oct. 12, 2010

(54) VIDEO SKILL GAME

(76) Inventor: John Fox, 3902 Q St., Omaha, NE (US) 68107

( * ) Notice: Subject to any disclaimer, the term of this patent is extended or adjusted under 35 U.S.C. 154(b) by 526 days.

(21) Appl. No.: 11/760,827

(22) Filed: Jun. 11, 2007

(51) Int. Cl.
*A63F 9/24* (2006.01)

(52) U.S. Cl. ..... 463/7; 463/8; 463/16; 463/23; 463/25

(58) Field of Classification Search ..... 463/16–20, 463/7, 8, 23, 25
See application file for complete search history.

(56) References Cited

U.S. PATENT DOCUMENTS 5,342,047 A * 8/1994 Heidel et al. ..... 463/29
6,015,344 A * 1/2000 Kelly et al. ..... 463/16
6,267,669 B1 * 7/2001 Luciano et al. ..... 463/7
6,648,759 B2 * 11/2003 Vancura ..... 463/20
6,712,693 B1 * 3/2004 Hettinger ..... 463/20
6,984,173 B1 * 1/2006 Piechowiak et al. ..... 463/20
7,322,886 B2 * 1/2008 Manz ..... 463/20
7,494,413 B2 * 2/2009 Singer et al. ..... 463/20
7,534,168 B2 * 5/2009 Bennett et al. ..... 463/20
7,585,221 B2 * 9/2009 Singer et al. ..... 463/20

* cited by examiner

*Primary Examiner*—Pierre E Elisca
*Assistant Examiner*—Shahid Kamal
(74) *Attorney, Agent, or Firm*—Caesar, Rivise, Bernstein, Cohen & Pokotilow, Ltd.

(57) ABSTRACT

A method of playing a game of skill is provided which includes providing a display, providing several different insignia, and providing a group of several sets of insignia. Each set includes an equal number of insignia in a prearranged order. The group includes first and last sets and a plurality of sets arranged in a designated order on a virtual track. The first set abuts the last set thereby forming a continuous virtual track. The order remains constant. A player provides credits for a play and the display sequentially displays one set of the plurality of sets in the designated order on for a finite period of time. Each set is displayed in a matrix until the player requests the sets to stop the sequential displaying at a particular set. The player is awarded credits for stopping the sequential displaying on a set displaying a winning pattern of indicia.

25 Claims, 15 Drawing Sheets

VIDEO SKILL GAME

BACKGROUND OF THE INVENTION

This invention relates to games of skill. More particularly, the present invention relates to games of skill that offer rewards for successful play.

A game of skill is a game, sometimes played on a machine whereby a result is derived by the player or participant's use of skills, as opposed to the result being controlled by chance. In other words, it is a game where the players or participants rely on their skill to get to the final result and not upon chance.

There are sometimes debates as to what constitutes a game of skill, many times with differing opinions, and differing philosophical legal arguments. There have been instances where claw toy machines, professional sports and even the stock market have been called into question.

A game of skill is a game where the outcome is determined mainly by mental and/or physical skill, rather than by pure chance.

A game of chance is a game, such as a dice game, in which chance rather than skill determines the outcome Philosophical arguments can and have been made about the existence of chance or luck. One side of the argument is that nothing is truly by chance or that nothing is random. Everything has a reason, or purpose, and everything can and is controlled. The other side of the argument is that everything is by chance, or is random. Things occur for no reason or purpose, under no control or direction. Therefore, one could argue that chance or luck does, or does not exist.

These arguments aside, it is generally agreed that skill games contain one or more, and in some cases all of the following:

1. a strategy to be applied;
2. the ability for the participant to improve;
3. an undefined or incalculable win rate; and
4. the player's skill or actions are the controlling factor in the game, rather than chance (this being the most widely accepted feature of a skill game).

Games of Skill include many different types of games and come in many different forms and packages. They can be found in a wide variety of places and locations. Common examples of skill games include pool, darts, golf, trivia, and target shooting games. Such games can be found in taverns, arcades, grocery and retail stores, carnivals, festivals, and golf courses. Skill games often reward prizes and return something of value to the participants. These rewards are things like toys, stuffed animals, gift certificates, and an endless array of novelties and merchandise.

Games of skill can also be found in many different places in many different locations. There are also many activities where people are able to win prizes for participating in games and other events. A few examples of places where games of skill can be found and other games where prizes can be won include arcades, retail stores, carnivals and festivals, state and county fairs, specialty restaurants, theme parks, special promotions, tournaments and leagues, game shows, and sports and performance-based pay.

Coin operated games of skill can be found all around us. Arcades, hotels, retail stores, and restaurants all play host to such games of skill. Coin operated, and sometimes non-coin operated games of skill can be found among other places at carnivals, state fairs, and church or school festivals.

There are a vast array of means and methods to compete for and obtain prizes that have little or nothing to do with chance. A golf tournament, playing a Cyclone Game, or selling cookies are just a few clear examples whereby prizes can be won.

All references cited herein are incorporated herein by reference in their entireties.

BRIEF SUMMARY OF THE INVENTION

A method of playing a game of skill is provided which includes the steps of providing a video display, providing an assemblage of a plurality of different insignia, and providing a group of a plurality of sets of insignia. Each set includes an equal number of insignia selected from the assemblage in a prearranged order. The group of a plurality of sets includes a first set and a last set and includes a plurality of sets arranged in a designated order on a virtual track. The first set abuts the last set thereby forming a continuous virtual track of sets. The order of sets on the virtual track remains constant. A player then provides an amount of credits (for example, in the form of money) for a play and the display sequentially displays one set of the plurality of sets in the designated order on for a finite period of time. Each set is displayed in a matrix until the player requests the sets to stop the sequential displaying at a particular set. The player is awarded credits for stopping the sequential displaying of a set on a set displaying a winning pattern of indicia. The matrix may include two or more rows and two or more columns. For example, a three by fifteen matrix would be acceptable for operation of the present invention.

Optionally, the step of providing the amount of credits includes providing money for a plurality of game plays. The credits are preferably displayed on the video screen. The step of providing the amount of credits for a play preferably includes selecting an amount of credits for a play from a list displayed on the video screen. Periodically, the plurality of sets of insignia may expand or contract to include at least one additional set or delete at least one set. A speed of the sequentially displaying of one set of said plurality of sets may be selected, which has an effect on the credits won or lost. The sequentially displaying of one set of said plurality of sets may include displaying a new set within a sufficient period of time that is within a generally accepted human reaction time. The sequentially displaying of one set of said plurality of sets includes displaying a new set approximately every 1.5 seconds. The sequentially displaying of one set of said plurality of sets includes moving the insignia of each set in the display in a continuous serpentine manner in the prearranged order. The sets may be continuously moved into and out of a field of display in a serpentine manner, whereby at any one moment of time, insignia from a new set entering or a previous set in play may be visible.

When a full set is visible in the field of display with no new set or previous set of insignia visible, the full set is displayed for a finite period of time (which is preferably within a generally accepted human reaction time, for example, half of one second).

An assemblage of, for example, eight different insignia may be used in each set. The set of a plurality of sets of insignia may include sets of having nine insignia in three by three matrices.

17. The step of awarding the player for stopping the sequential displaying of a set on a set displaying a winning pattern of indicia, wherein the winning pattern may be selected from the set of patterns selected from three in a horizontal row, three in a vertical row, and three in a diagonal row of the three by three matrix.

The step of awarding the player credits for stopping the sequential displaying of a set may include awarding a progressively increased amount of credits for fast response time for the player requesting the sets to stop and a progressively decreased amount of credits for a slow response time.

The method of playing a game of skill may include the step of designating one of the plurality of different insignia as wild, wherein the insignia designated as wild may be considered equivalent to any other of the insignia in a set. The player may designates his or her preferred insignia as wild. The step of awarding the player credits subsequent to stopping the sequential displaying of a set and designating one of the plurality of different insignia as wild, may include awarding a progressively increased amount of credits for fast response time for the player designating an insignia as wild and a progressively decreased amount of credits for a slow response time for designating an insignia as wild.

The method may include providing one or more bonus games that are awarded upon the display of a designated set of indicia, wherein the chances of winning the bonus game is not based on skill.

In another embodiment of the present invention, method of playing a game of skill is provided wherein the step of providing a set of a plurality of sets of insignia, includes providing sets in a matrix of at least two horizontal rows and at least two vertical rows, wherein one of the rows is designated as a win line, and wherein the step of awarding the player for stopping the sequential displaying of a set on a set displaying a winning pattern of indicia, includes the step of a player selecting at least one insignia for movement from a row onto the win line to obtain a winning combination of insignia. The step of awarding the player credits may include awarding a progressively increased amount of credits for fast response time for the player selecting at least one insignia for movement and a progressively decreased amount of credits for a slow response time for selecting at least one insignia for movement. Finally, a bonus game that is awarded upon the display of a designated set of indicia may be included, wherein the chances of winning the bonus game is not based on skill.

BRIEF DESCRIPTION OF SEVERAL VIEWS OF THE DRAWINGS

The invention will be described in conjunction with the following drawings in which like reference numerals designate like elements throughout the several views and wherein.

DETAILED DESCRIPTION OF THE INVENTION

Figure 1:
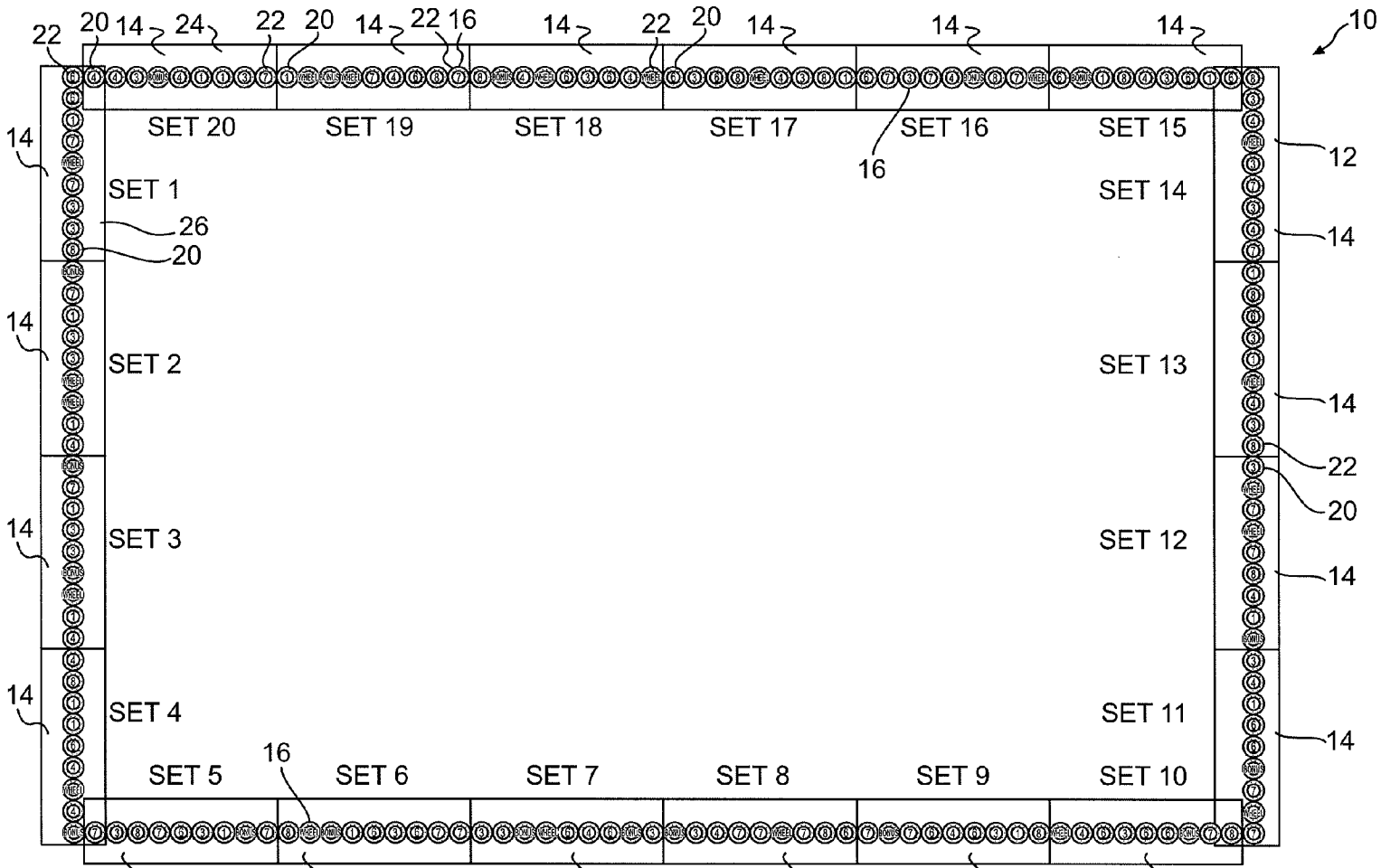
FIG. 1 is schematic top view of an example of a plurality of sets of insignia, arranged in a designated order on a virtual track, in accordance with a preferred embodiment of a video skill game of the present invention.

The invention will be illustrated in more detail with reference to the following embodiments, but it should be understood that the present invention is not deemed to be limited thereto.

The present invention is direct to a game device which is both electronic and mechanical and uses a color monitor through which images are displayed to a player. The device awards, for example, both free games and tickets (which are redeemable for prizes). The device is operated via player control, which may include buttons, a touch screen, or both. The player may select from several credit point levels (e.g., $0.50) for which to play, however, the device does not contain a multiple "Bet" option. Preferably, the device accepts U.S. twenty-five cent pieces ($0.25) as well as U.S. paper currency. The prizes and win amounts are determined, in large part, based on the player's use of skill and general player interaction. The device preferably does not contain any dipswitches or other similar devices for the purpose of setting or "locking" in game percentage. Preferably, the prizes and their ranking from highest to lowest are constantly displayed to the player. Preferably, the game rules and instructions are always available for the player to view. Preferably, the device does make use of optional features that have a bearing on difficulty of obtaining prizes. For example, a players' choice timer may be set at several levels to best fit the skill level of player within a particular establishment. That is, depending upon a player's selected speed of play, awards may be increased or decreased. For example, if a player selects the highest game speed, a corresponding highest level of awards will be offered.

The device uses, for example, a set of only 30,796 possible outcomes. A winner is possible in every game played. Decisions made by the player can and do affect the size of the win in every game played. The speeds by which a player makes decisions and executes them affects win amounts and prizes of every game played. The player will likely improve his or her performance of obtaining prizes over time.

Referring now to the drawing figures wherein like part numbers refer to like elements throughout the several views, there is shown a virtual track 10 of a group 12 of a plurality of sets 14 of insignia 16 used in a preferred embodiment of the game of skill in accordance with the present invention. The player's decision determines which set 14 of insignia 16 within the group 12 will be played. See FIG. 1. The sets 14 travel in order along the virtual track 10 and only stop and come into play upon the player's action. The sets 14 of insignia 16 within the group 12 are not randomized. Additionally, the sets 14 themselves are not randomized. The sets 14 and group 12 are composed in order via pre-determined parameters. The order of the sets 14 and insignia 16 within a set 14 does not change.

There are two phases to a game play: Phase 1 and Phase 2. There is never a pat winner in Phase 1 of the game. A winner is always possible within each set 14. The player must create a winning combination via use of decision-making skills. The player win amount is affected by the speed in which the player makes the decisions. The game machine consists of no random events. The player controls everything. The player win rate is not calculable as it is controlled by the player decisions. Simulation data is available based on parameters resulting in a player win rate from, for example, 0% to a percentage in excess of 100% (for example, 130%).

Figure 2:
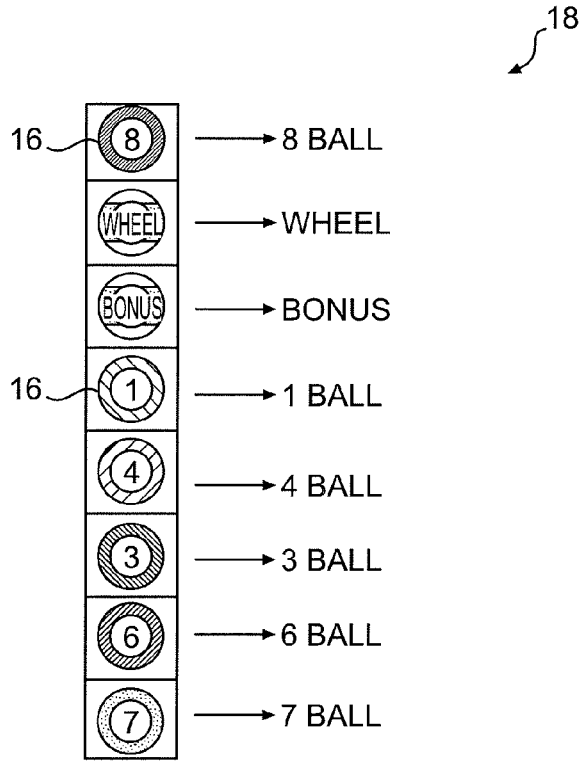
FIG. 2 is a top view of an assemblage of a plurality of different insignia used in the example of a plurality of sets of insignia of FIG. 1.
Figure 3:
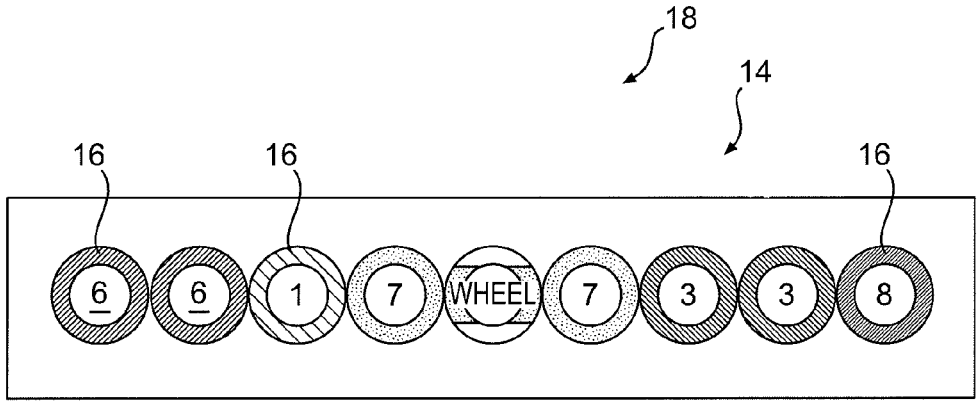
FIG. 3 is an example of a set of nine insignia, selected from the assemblage of insignia of FIG. 2 and a selection of the nine insignia are used in one of the sets of insignia of FIG. 1.

The video skill game of the present invention will now be described. FIG. 2 shows an assemblage 18 of eight possible insignia 16. Insignia 16 are formed into sets 14 of nine as shown in FIGS. 1 and 3. Each set 14 of nine has a beginning insignia 20 and an ending insignia 22.

Each set 14 of nine is initially laid out geometrically in a three by three matrix (see FIGS. 5 and 6) so that no winning patterns are contained within the "first phase" of game play, and at least one winner is always possible in the "Second Phase" of game play. Sets 14 of nine are arranged into a group 12. For this example, see FIG. 1 which is a group 12 comprised of 20 sets 14 of nine.

The composition of the sets 14 and group 12 is created outside of the game machine using a detailed listing of parameters for arrangement. The sets 14 and group 12 are not randomized either inside or outside the game machine.

Figure 4:
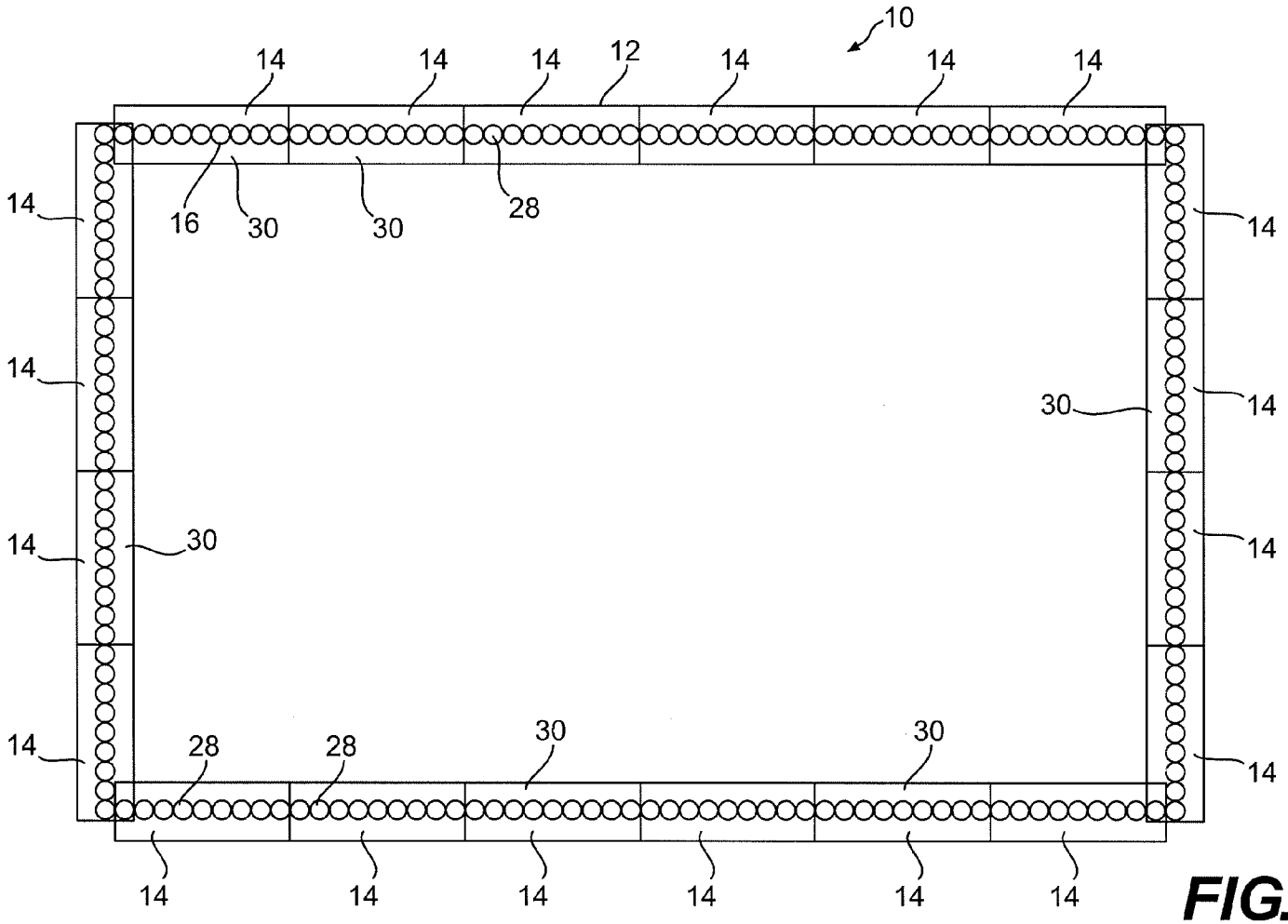
FIG. 4 is a schematic top view of the virtual track of FIG. 1, without any insignia shown.

As can be seen in the example of FIG. 1, within the group 12, there is no beginning and no end. When the last set 24 is displayed, the first set 24 follows it. This is illustrated in the example of FIG. 4. In FIG. 4, each circle 28 represents an insignia 16. Each rectangle 30 separates each set 14 of nine insignia 16. Since an entire group 12 is displayed, there is no beginning, and there is no end (as can be seen in the example of FIG. 4. It is continuous on the virtual track 10. See also FIG. 1.

The group 12 is placed onto the virtual track 10. Each set 14 is preceded by the same set 14 on each revolution of the virtual track 10. That is, the order of the sets 14 does not change within the group 12.

There may be one or more sets 14 of nine that may "jump into" the a location in the group 12 based on predefined sets of parameters. For example, a set 14 one may appear only once in revolutions of the virtual track 10 of the group 12.

The player is greeted by the device containing a monitor, such as an LCD or CRT monitor, which displays a plurality of insignia. See, for example, FIG. 5.

Figure 5:
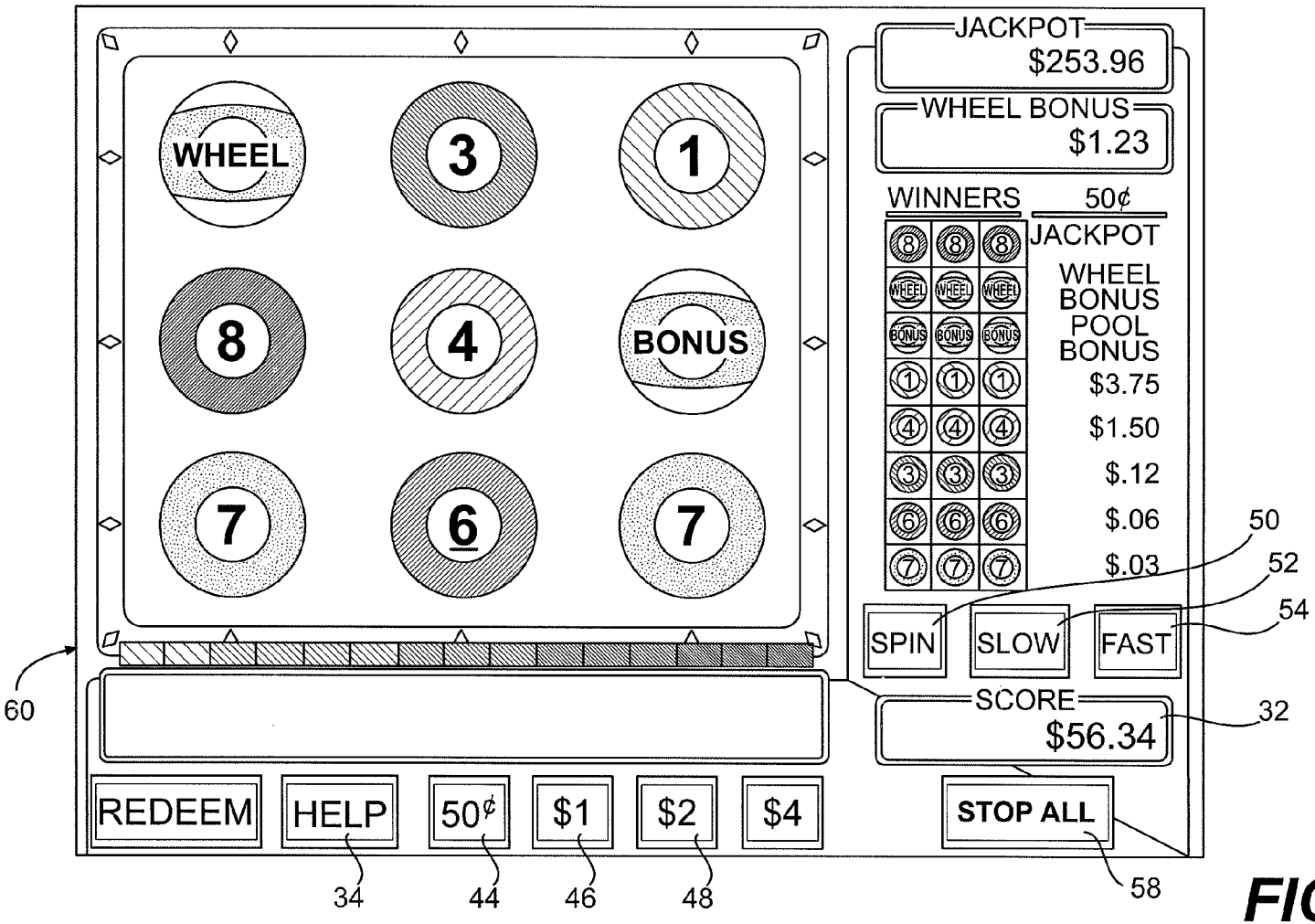
FIG. 5 is a sample screen of a video skill game in accordance with a preferred embodiment of the present invention, which makes use of the virtual track of FIG. 4.
Figure 6:
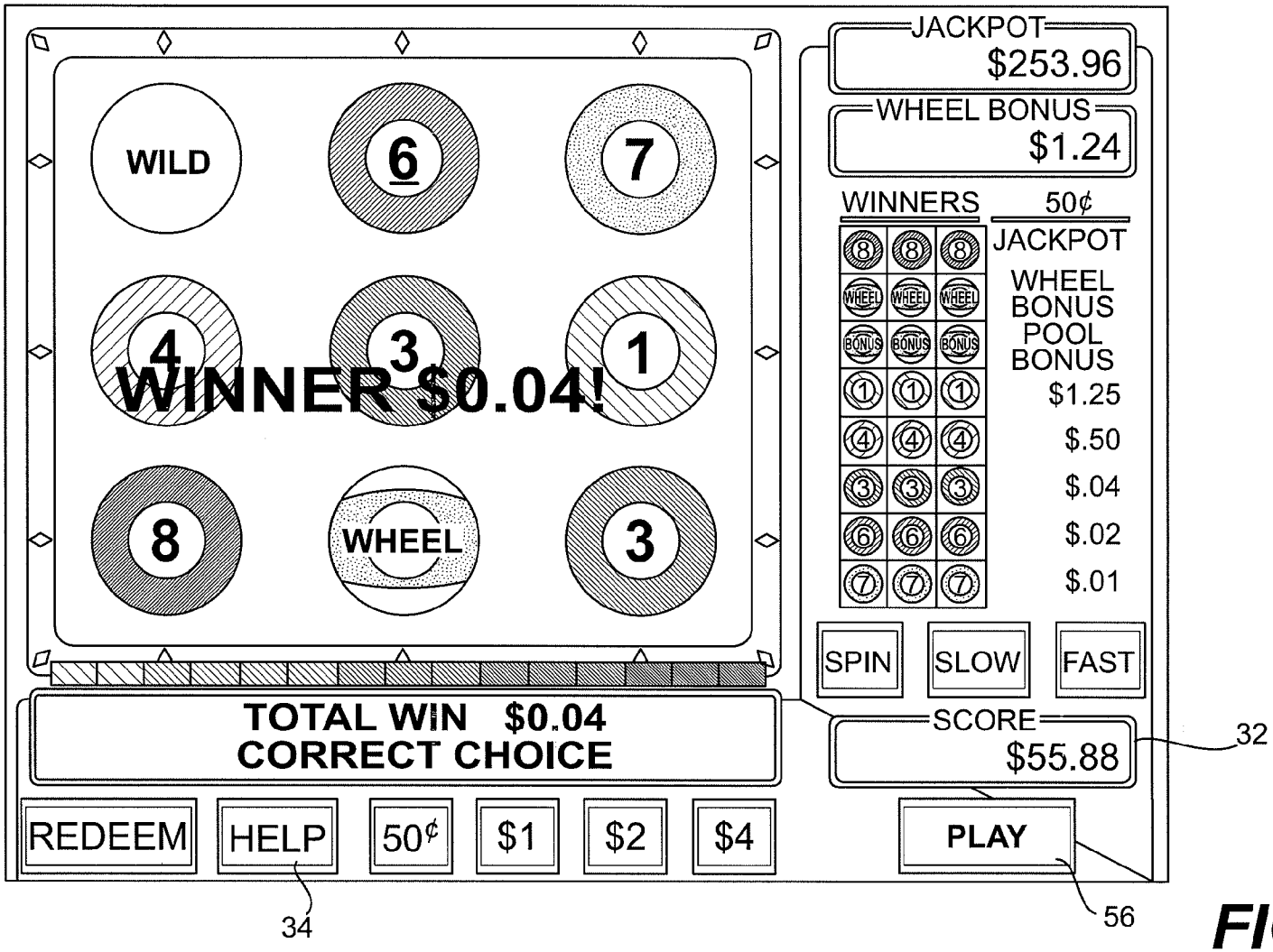
FIG. 6 is another sample screen of video skill game in accordance with a preferred embodiment of the present invention, which makes use of the virtual track of FIG. 4, showing a winning play of two threes and a wild insignia along a diagonal line.

The player inserts coins or currency into the device and receives credits based on the amount of coins or currency inserted. The amount of credits purchased is displayed to the player within via the monitor, as shown in FIGS. 5 and 6.

Figure 7:
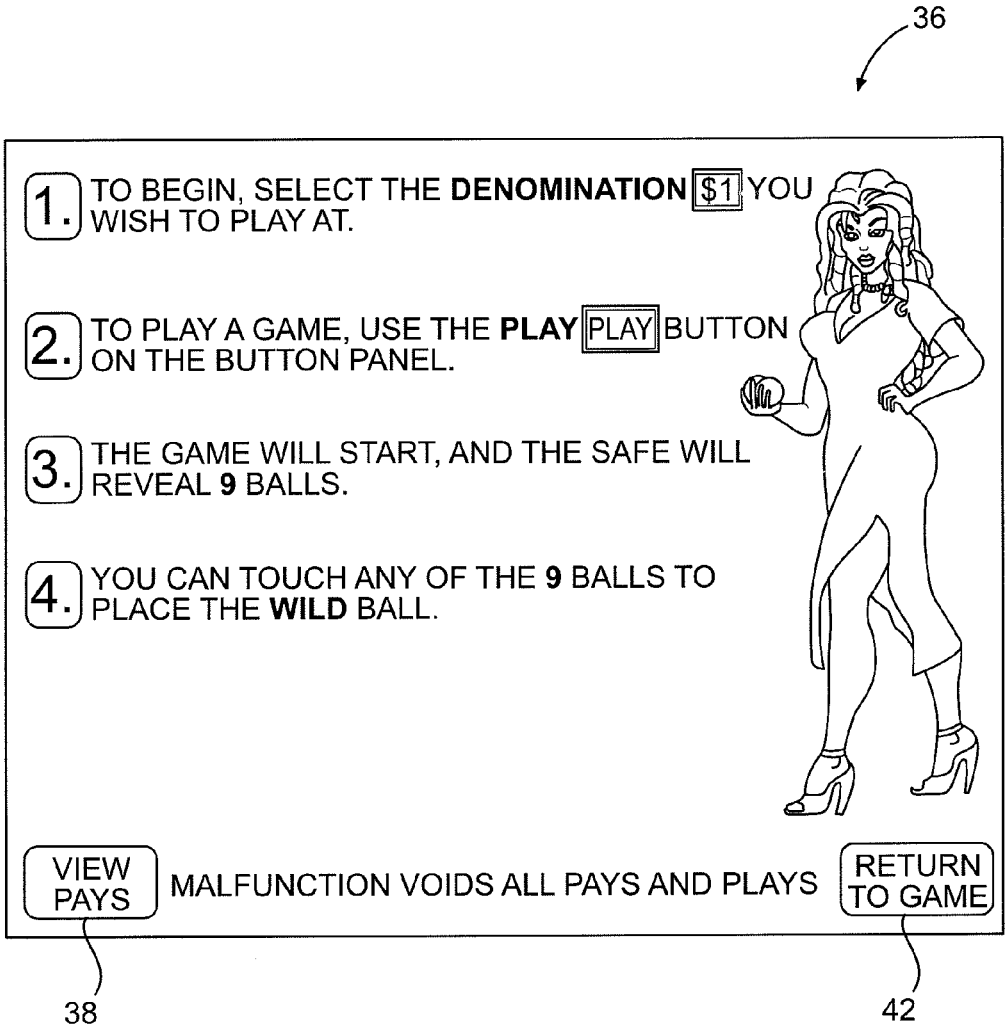
FIG. 7 is a sample "Help" screen of the video skill game of FIG. 6, showing instructions for playing the game.

At any time, the player may view game rules and instructions by pressing a "HELP" button 34 displayed on the screen. Again, see FIGS. 5 and 6. Pressing the "HELP" button will bring the player to an instructional screen 36 as shown, for example, in FIG. 7. Once in the screen 36, the player can touch a "VIEW PAYS" button 38 to see what winners pay, or they can touch "RETURN TO GAME" 42 to exit the help screen 36 and return to game play.

Figure 8:
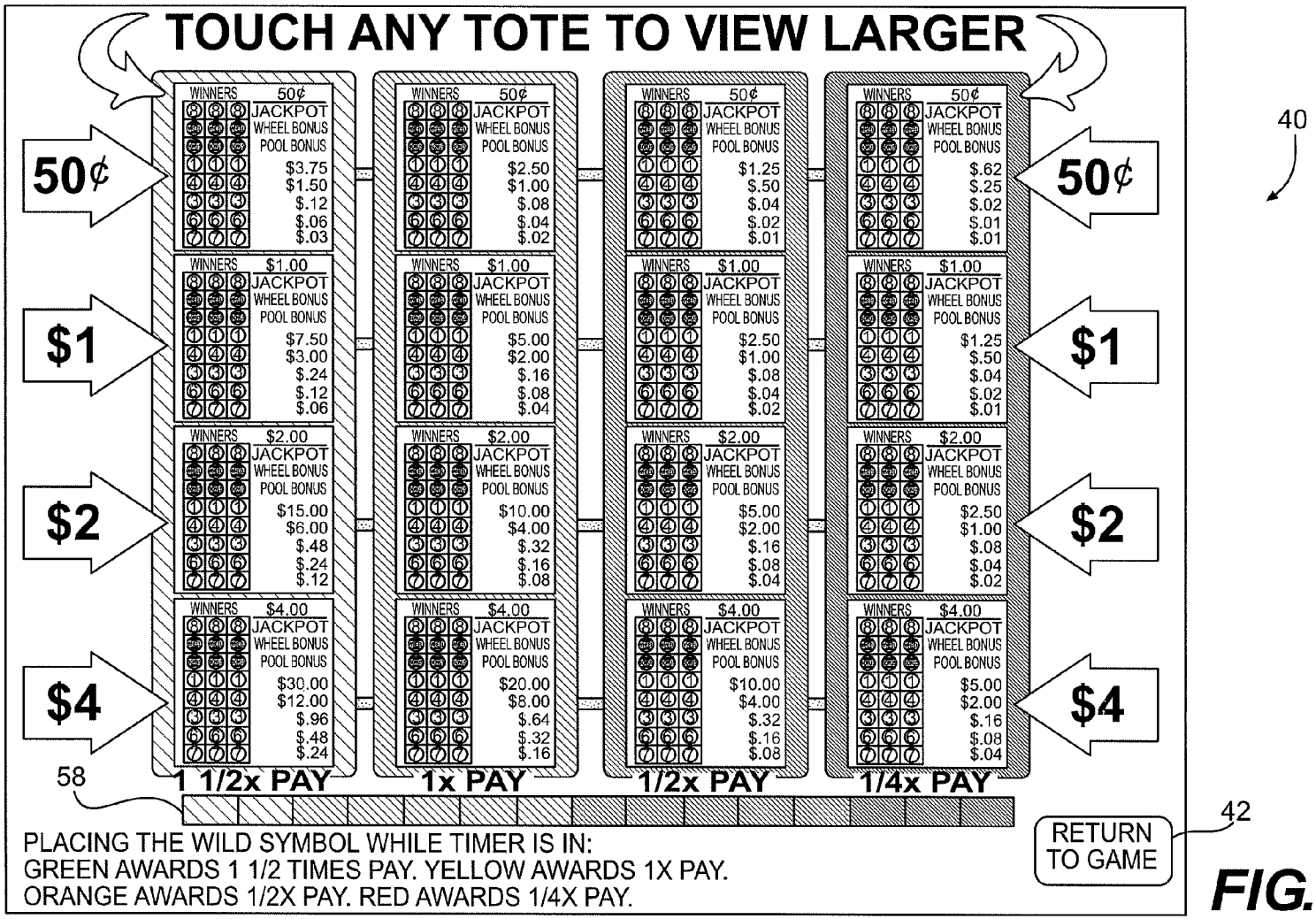
FIG. 8 is a sample of payout screen for $0.50, $1.00, $2.00 and $4.00 game play fees, for the video skill game of the present invention, showing different pay amounts for different combinations of insignia.
Figure 9A:
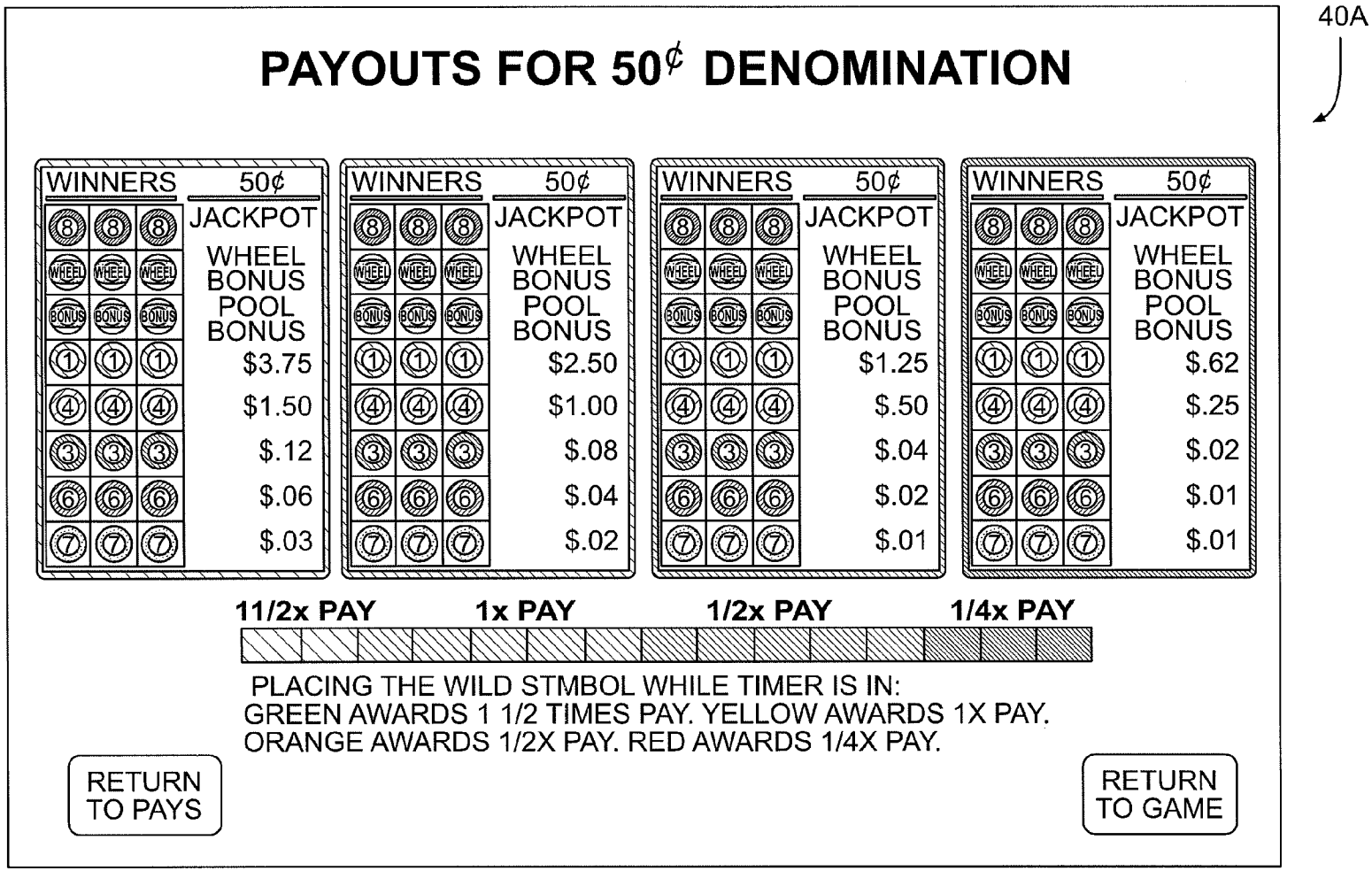
FIGS. 9A, 9B 9C and 9D are expanded views of the payout table screen of FIG. 8.
Figure 9B:
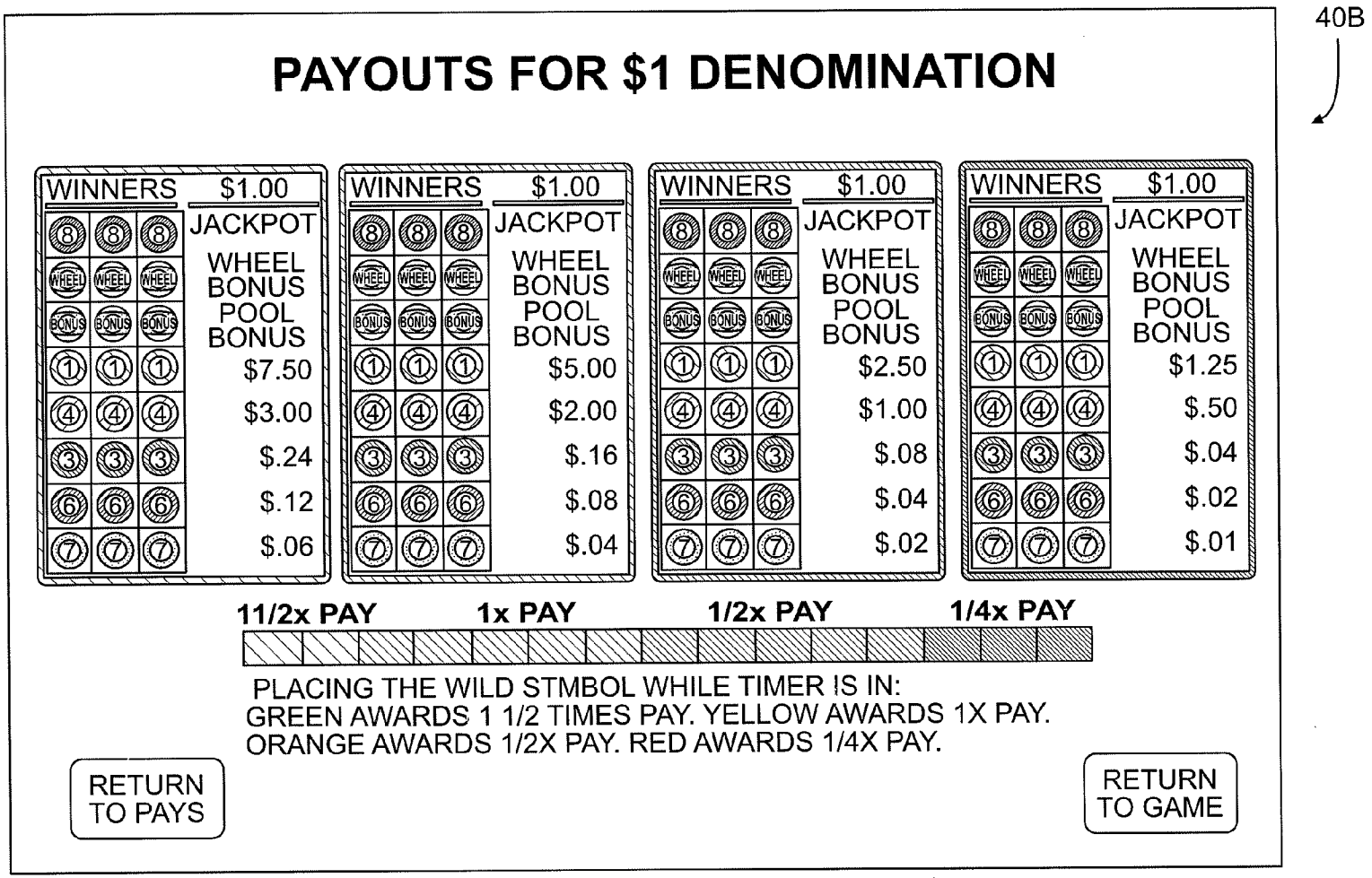
Figure 9C:
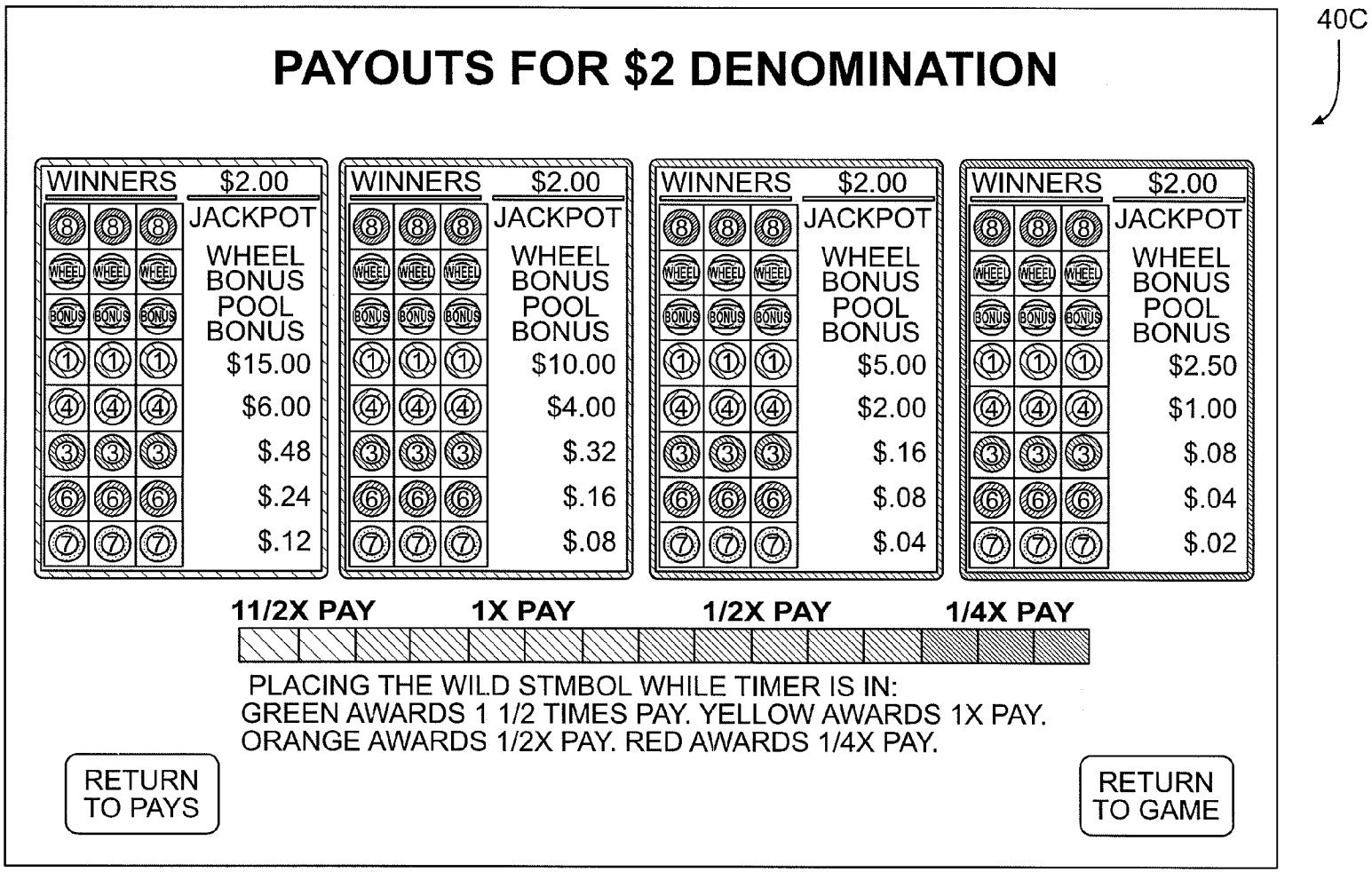
Figure 9D:
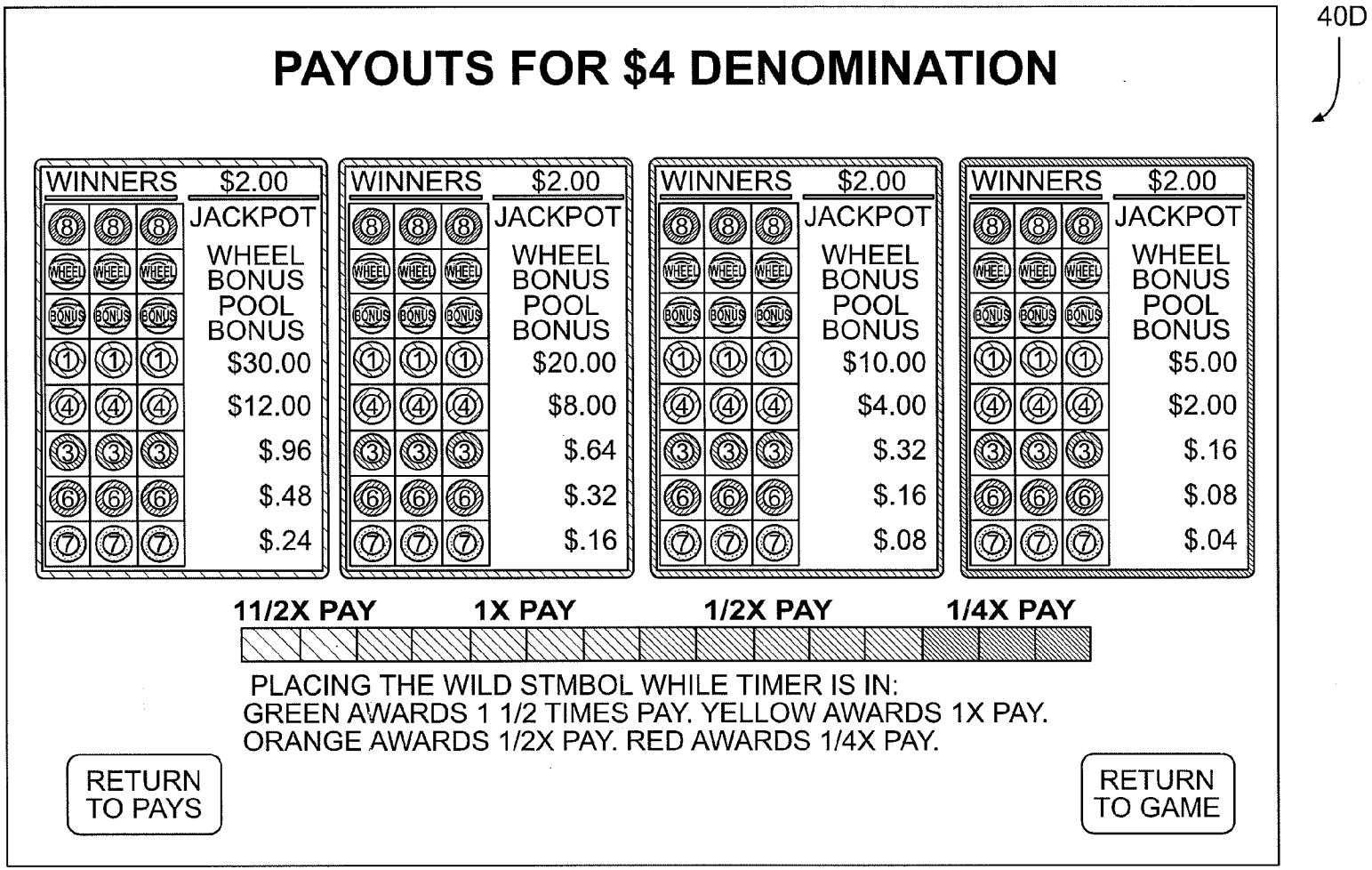

If the player chooses "VIEW PAYS" (see FIG. 8), the device will display a screen that shows pays for all denominations 40. See FIG. 7. If, at this point, the player wants to view a larger screen for a particular denomination, he or she must touch a location on the monitor within the denomination they wish to see. This brings one of the four screens shown in FIGS. 9A, 9B, 9C and 9D, depending on which denomination the player wished to view showing screen shots 40A, 40B, 40C, 40D for pays for each of $0.50, $1.00, $2.00 and $4.00 denominations. For example, a player enters credits and, subsequently, the player enters the "Help" screen 36. After the player returns to the game from the "Help" screen 36, the player is ready to play the game.

The player may now choose from four cost of play denominations 44, 46, 48 (for example, $0.50, $1.00, $2.00, $4.00) by touching his/her choice as displayed in the lower center portion of the screen. See FIGS. 5 and 6. The denominations are displayed lowest to highest (left to right). It's likely the player will test and develop their skill levels on lower denominations before moving to the higher denominations as their skill levels increase. See FIG. 5.

Once the cost of play denomination is selected, the player chooses the direction in which the groups of insignia will move on the screen (i.e., along the virtual track 10, even though only one set 14 of indicia of the group 12 is active at any one time). The player may touch "SPIN" 50 or "SLOW" 52 or "FAST" 54 to select a movement speed See FIG. 5.

After the player has chosen one of the three movement speeds 50, 52, 54, the player then presses "PLAY" 56 to begin the game. See FIG. 5.

Figure 10:
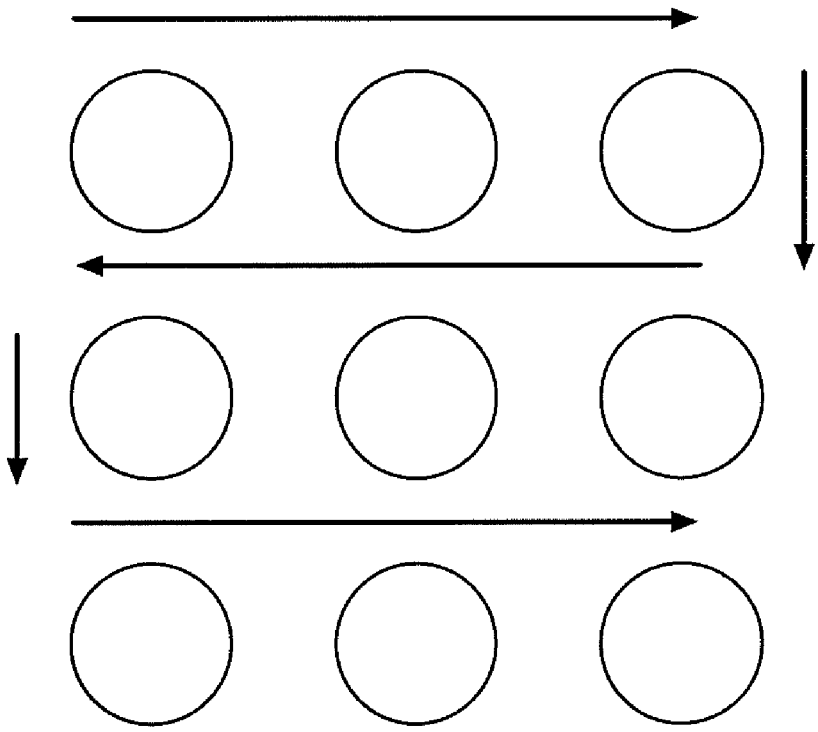
FIG. 10 is a schematic diagram of a set of nine insignia, showing a serpentine travel pattern which the insignia travel on the screen.

To begin the game, the screen of the game machine will be displaying the moving sets 14 of insignia 16, that, if "slow" 52 or "fast" 54 is selected, serpentine in the pattern shown in FIG. 10. There are three types of movements that the player may optionally select. In the first type of movement, "spin," the track speed is 1.5 seconds with no pause. In the second type of movement, "slow," the track speed is 0.5 seconds with a one-third second pause between sets 14. In the third type of movement, "fast," the insignia will spin and pause for one-third seconds on a new set and repeat. In any of these cases, the sets will move along via the track 10 in order, then pause on a set 14, then move again up until the player stops the movement.

If the player chose "SPIN" 50 before hitting play 56, the insignia 16 spin and pause on new sets 14 of insignia 16 until the player hits "STOP ALL" 58. See FIG. 5. If the player chose "SLOW" or "FAST" before hitting play, the insignia move around the screen.

The insignia 16 continue to move around the screen until the player hits "STOP ALL" 58 on the set 14 of insignia 16 they choose. See FIG. 6. The player will try to stop on a set 14 of insignia 16 that produces a big winner. The insignia 16 are displayed in a three by three matrix (see FIGS. 5 and 6) with eight possible winning directions, in the same form as a tic-tac-toe pattern (three horizontal rows, three vertical columns, diagonal from top right to bottom left and diagonal from bottom right to top left). This is the "Beginning Set."

At no time do the sets 14 auto-stop without player interaction. It should be noted that the viewable time of each set 14 is within long-standing and generally accepted human reaction times (See Hochheim, Hock, *Hick's Law? Hicks Legacy: Reaction Time In Combat* (2005) Available: http://www.hockscqc.com). Hick's law was first proposed in 1952 and states that response times increase in proportion to the logarithm of the number of potential stimulus-response alternatives; it is expressed in the equation TR+a+b {Log 2 (N)}. In other words, the more choices one has to choose from, the longer it takes to make a decision. Also, according to Hock Hochheim, although Hick did not state a certain number of milliseconds it takes to decide between options, most researchers today believe that the time it takes to decide on an action is about 150 milliseconds. Since there are 1,000 milliseconds in one second, this means it typically takes about a tenth of a second to decide on one action. Since each additional choice effectively doubles the decision time, if you have two choices, it will take about 300 milliseconds to make a decision, three choices will take about 600 milliseconds, etc.

Simply put, the player chooses where the sets 14 stop on the virtual track. "Phase two" will be described below. In one embodiment, Phase two involves the player choosing one insignia to replace with a WILD symbol. Every group that the player can potentially choose has a possible winner during Phase two.

This part of the game is timed. If the player hits "STOP ALL" relatively quickly, he or she has the chance to win the most possible. As more time goes by before hitting "STOP ALL," the player has the chance to win less and less. The more skill the player has, the more he or she will have the possibility of winning.

There may be many possible winners in the beginning set. The screen preferably displays a redemption amount of wins that can be exchanged for merchandise.

Phase Two, Variation One, after "Stop all" is Pressed:

The player is then ready to replace one insignia with a WILD. The player must now evaluate the nine symbols and identify the winning combinations. After doing so, the player decides which insignia to replace.

Once the decision is made, the player touches the insignia that he or she wishes to replace. In other words, the player will discard one of the nine insignia by touching the screen of the device. The discarded symbol is always replaced with a "WILD" which is the substitute for any other symbol. The amount of the winning pattern and the amount of the highest possible winning pattern on that particular set are always displayed to the player following each game. This enables the player to view and learn the highest possible winning patterns.

There is never a winning combination within the first set of insignia.

As shown in FIG. 6, the player chose to replace the top right insignia with the "WILD." This was the best and correct choice (three "NUMBER 3 BALLS" on the diagonal). The player is informed that they made the best possible choice, and the winner is paid.

This part is timed also. The more time it takes the player to choose which one to replace with a WILD, the less he/she can win. The timer bar graph 60 is visible in FIG. 6 which shows half the time elapsed. If the player has taken too much time, and the timer is exhausted by the player, the player, in this case, would win nothing because he/she took too long to choose which symbol to replace.

Because the group 12 and the sets 14 are predetermined, winning patterns are always present. The win amounts vary based on what the insignia are and the speed of selection. The win amount is always displayed to the player.

Figure 6A:
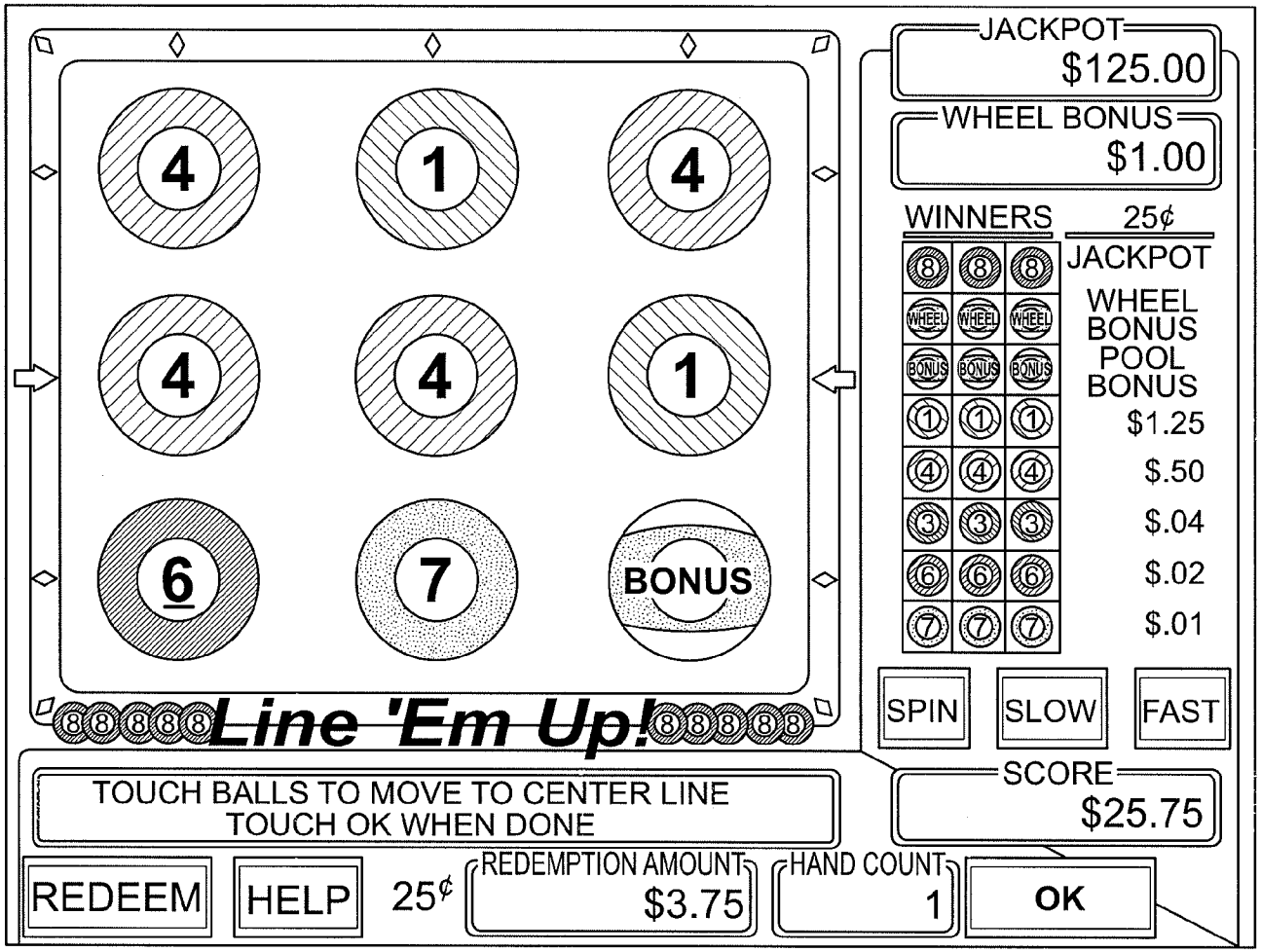
FIG. 6A is a sample screen of a video skill game in accordance with another preferred embodiment of the present invention, which makes use of the virtual track of FIG. 4.
Figure 6B:
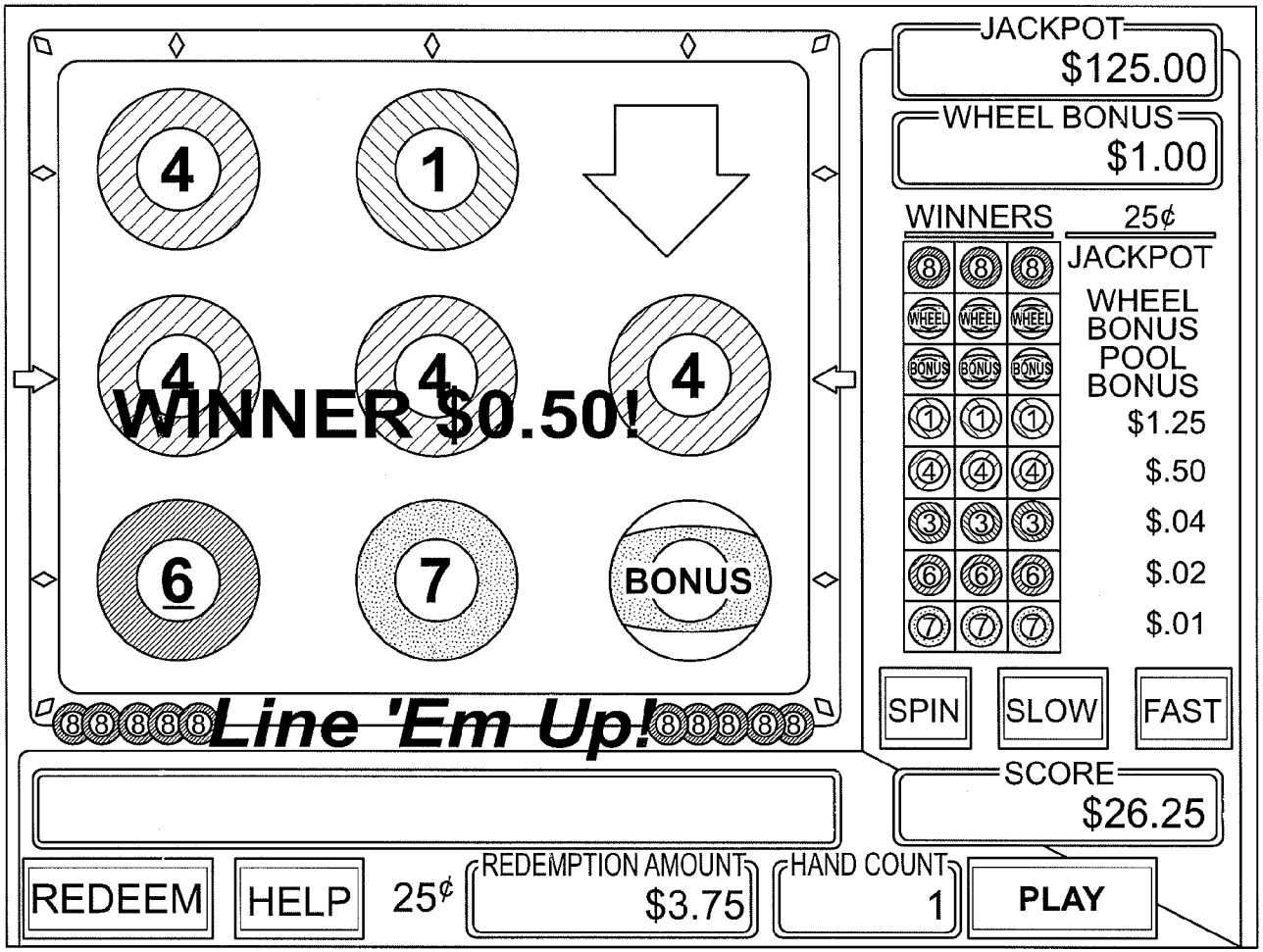
FIG. 6B is a sample screen of a video skill game in accordance with the preferred embodiment of FIG. 6A, showing a winning combination of insignia along a win lien.

Phase Two, Variation Two, after "Stop all" is Pressed:

Here, again, the insignia are preferably displayed in a three by three matrix, as can be seen, for example, in FIG. 6A. One of the rows or columns is designated as a "win line" (either by the player or by the machine), by, for example, arrows displayed. A player then decides which insignia to move to the win line from other insignia in the matrix. A player may move one, two or three of the nine insignia by, for example, touching the screen. The selected insignia are move to the win line at the adjacent position to form a "line-up" combination. See FIG. 6A which shows a screen subsequent to the "Stop All" button being pressed, but prior to the player moving insignia on the screen. A "win line" is shown with arrows which designates the center row of insignia in the matrix. FIG. 6B shows an insignia in the upper left corner of the matrix moved to the center row in the same column. A large arrow shows that this insignia was moved. That is, in this example, the player chose to move the top right insignia (a number 4 ball) to the play line, thereby lining up three number 4 balls on the play line. This was the best and correct choice and the winner is paid (i.e., the redemption amount on the screen is increased).

The amount of the winning pattern and the amount of the highest possible winning pattern on that particular matrix are always displayed to the player following the game. This enables the player to view and learn the highest possible winning pattern. It is noted that there is preferably never a winning combination within the first set of indicia. If a player does not make the right selection or if the timer expires, the player wins nothing. However, winning patterns are always present. The win amounts vary based on what the insignia are and which insignia are chosen by the player. The win amount is always displayed to the player.

The player's speed is a factor in completing a winning set or combination. Once the "stop all" button has been pressed, the player has, for example, 15 seconds (displayed on a timer bar) to line up a winning pattern. If the player does not line up a correct set within 15 seconds, the player is not rewarded.

The steps of the present invention for the example, of Variation Two are as follows:

a) player sees screen with "Score" set to zero ($0.00);
b) player inserts credits (e.g., money) into the machine; the "Score" shows amount (e.g., $200.00);
c) the player may request help and an instruction screen or screens appears;
d) the player presses a "Play" button to begin game play; the insignia begin to move
e) the player presses "Stop All" to stop movement of the insignia which form, for example, a three by three matrix; once the insignia stop, a timer starts which is displayed on the screen;
f) a "Win Line" is displayed on the screen, for example, the center row of the three by three matrix;
g) the player selects insignia to move from the top and bottom row of the matrix onto the "Win Line;" if the player selects a winning combination (a table of winning combinations with win amounts shown may be displayed; see FIGS. 5A and 5B), the player's "Score" is credited with the win; the faster the player reacts, the more he or she wins; if the player reacts too slowly, the player does not win;
(h) the player again hits the "Play" button;
(i) once the player is finished playing, he or she may hit a "Redeem" button to obtain credits for rewards;
(j) if the player is a high scorer, he or she may enter his or her initials for display on a "High Score" list, with the amount of winnings shown.

As stated, the player's speed is a factor in the win amount. If the player gives a correct winner in the given time period (for example, 0.3 seconds is a default time), the pay is, for example, 50% larger than if the same winning pattern is made in 0.3-1.8 seconds. The winning amount falls an additional 50% if the choice is not made within 1.8-4 seconds, and finally, no winning pattern is allowed after 4 seconds. The player will know which pay category they are currently in by looking at the speed bar on the screen. See FIG. 6.

The player must balance the need for fast selections with the need for careful evaluation of the symbols needed to create the best possible winning combinations.

The game may contain one or more bonus games intended to increase player appeal and accentuate the entertainment value and anticipation of each play. The following is an example of a bonus game.

Figure 11:
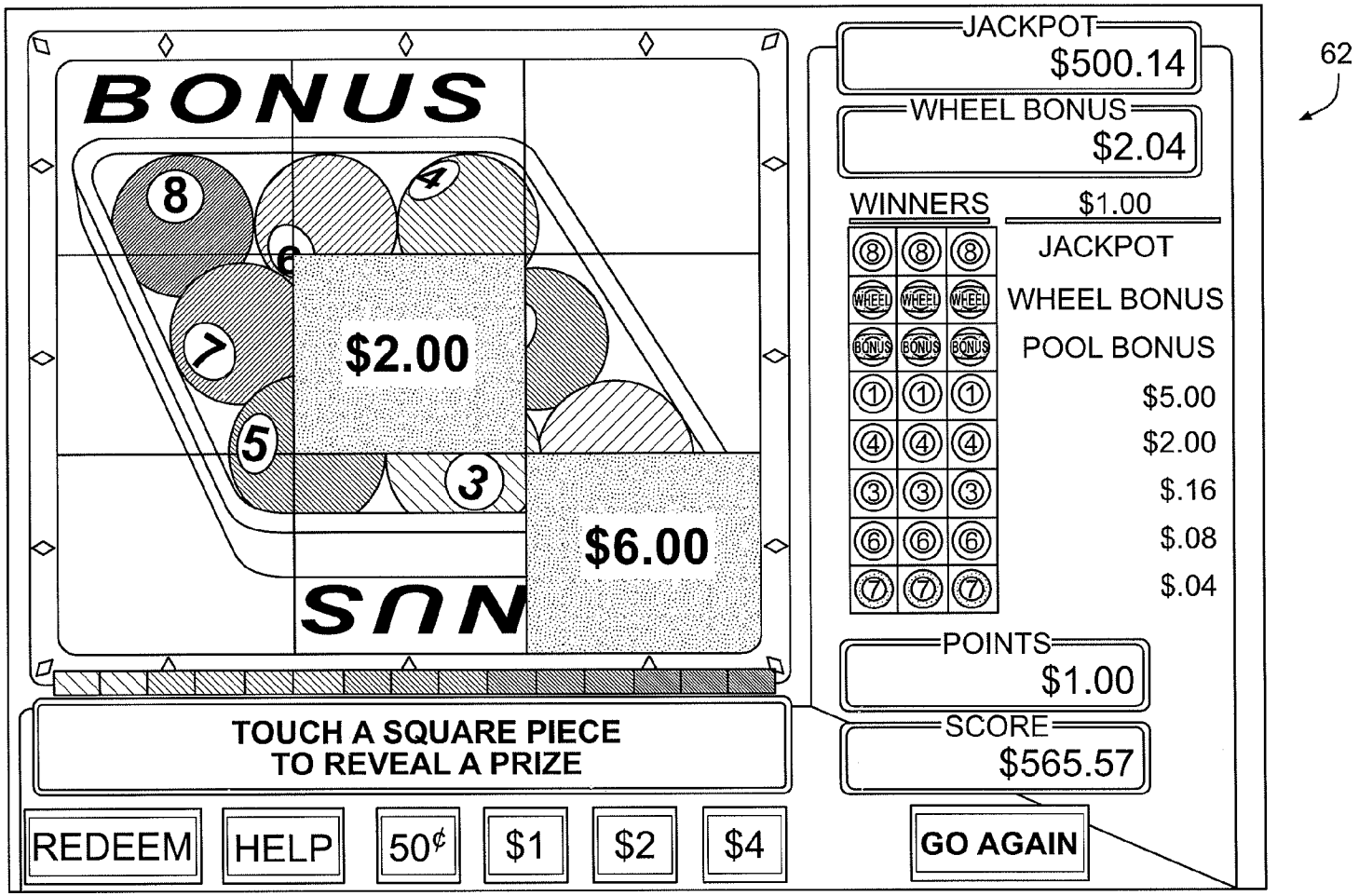
FIG. 11 is an example of a bonus screen for use with the video skill game of the present invention.

The "Pool Bonus" function (see screen shot 62), shown in FIG. 11, is as follows. Upon the player lining up the three appropriate symbols (as described above), the screen is transformed into a pool rack. The player makes a selection and touches the screen in any of the nine squares to reveal a prize.

The player repeats these steps until a stopper symbol is displayed. Although no skill is used inside the bonus game itself, the bonus game cannot be obtained without the player's use of skill. The player needs to line up, for example, three "BONUS" symbols in order to activate the bonus.

The "wheel bonus" game, a screen shot 64 of which is shown in FIG. 11, is as follows. Upon the player lining up the three appropriate symbols, the screen is transformed into a spinning wheel display. The player makes a selection and touches the screen in the "stop" button position to stop the wheel.

The wheel will stop on a particular multiplier that will multiply the wheel bonus pool as displayed on the main screen. The bonus pool increases varying amounts each or nearly each time the game is played. Although no skill is used inside the bonus itself, (such as revealing a prize within a balloon that has been popped by a dart), the bonus cannot be obtained without the player's use of skill, which is needed to line up the symbols necessary to activate the bonus.

Games of skill that award prizes are already commonly found in such places as supermarkets, department stores, and arcades. The video skill game of the present invention is intended to be a skill game designed for a mature clientele. It is intended to be played for fun and prizes in places where adults congregate, such as local bars and truck stops. Chance is not the controlling factor. The player's skill is the controlling factor, thus making the present game a game of skill.

While the invention has been described in detail and with reference to specific examples thereof, it will be apparent to one skilled in the art that various changes and modifications can be made therein without departing from the spirit and scope thereof.

What is claimed is:

1. A method of playing a game of skill, comprising:

(a) providing a game device having a player control and a video display;

(b) providing an assemblage of a plurality of different insignia by the game device;

(c) providing a group of a plurality of sets of insignia, by the game device, wherein each set includes an equal number of insignia selected from said assemblage in a prearranged order, said group of a plurality of sets including a first set and a last set;

(d) said group of a plurality of sets arranged on the video display in a designated order on a virtual track, and wherein said first set abuts said last set forming a continuous virtual track of sets and wherein the order of sets on the virtual track remains constant;

(e) providing and displaying on the video display an amount of credits for a play by a player, by the game device;

(f) sequentially displaying, on said video display by the game device, one set of said plurality of sets in said designated order on said video display for play, each set being displayed for a finite period of time, each set being displayed in a matrix until the player requests the sets to stop, via the player control, the sequential displaying at a particular set, the player utilizing skill in the form of reaction time to attempt to cause the a winning pattern of indicia to be displayed; and (g) awarding by the game device, and displaying on the video display, the player credits for the player causing the stopping of the sequential displaying of a set on a set displaying a winning pattern of indicia, whereby the awarding is based in substantial part on timing skill of the player to determine, utilizing the stopping of the set on a winning pattern, wherein a fast reaction time by the player increases credits awarded.

2. The method of playing a game of skill of claim 1, wherein the step of providing the amount of credits includes providing money for a plurality of game plays.

3. The method of playing a game of skill of claim 2, wherein the credits are displayed on the video screen.

4. The method of playing a game of skill of claim 1, including the step of providing a amount of credits for a play includes selecting an amount of credits for a play from a list displayed on the video screen.

5. The method of playing a game of skill of claim 1, wherein the set of the plurality of sets of insignia is periodically expanded to include at least one additional set.

6. The method of playing a game of skill of claim 1, wherein the set of the plurality of sets of insignia is periodically contracted to delete at least one set.

7. The method of playing a game of skill of claim 1, selecting a speed of the sequentially displaying of one set of said plurality of sets.

8. The method of playing a game of skill of claim 1, wherein the sequentially displaying of one set of said plurality of sets includes displaying a new set within a sufficient period of time that is within a generally accepted human reaction time.

9. The method of playing a game of skill of claim 1, wherein the sequentially displaying of one set of said plurality of sets includes displaying a new set approximately every 1.5 seconds.

10. The method of playing a game of skill of claim 1, wherein the sequentially displaying of one set of said plurality of sets includes moving the insignia of each set in the display in a continuous serpentine manner in the prearranged order.

11. The method of playing a game of skill of claim 1, wherein the sets are continuously moved into and out of a field of display in a serpentine manner, whereby at any one moment of time, insignia from a new set entering or a previous set in play may be visible.

12. The method of playing a game of skill of claim 11, whereupon when a full set is visible in the field of display with no new set or previous set of insignia visible, the full set is displayed for a finite period of time.

13. The method of playing a game of skill of claim 12, wherein the finite period of time is a sufficient period of time is within a generally accepted human reaction time.

14. The method of playing a game of skill of claim 12, wherein the finite period of time is one half of one second.

15. The method of playing a game of skill of claim 1, wherein the step of providing an assemblage of a plurality of different insignia includes providing an assemblage of eight different insignia.

16. The method of playing a game of skill of claim 1, wherein the step of providing a set of a plurality of sets of insignia, includes providing sets of having nine in a three by three matrix.

17. The method of playing a game of skill of claim 16, wherein the step of awarding the player for stopping the sequential displaying of a set on a set displaying a winning pattern of indicia, includes awarding where the winning pattern is selected from the set of patterns selected from three in a horizontal row, three in a vertical row, and three in a diagonal row of the three by three matrix.

18. The method of playing a game of skill of claim 1, wherein the step of awarding the player credits for stopping the sequential displaying of a set, includes awarding a progressively increased amount of credits for fast response time for the player requesting the sets to stop and a progressively decreased amount of credits for a slow response time.

19. The method of playing a game of skill of claim 1, including the step of designating one of the plurality of different insignia as wild, wherein the insignia designated as wild may be considered equivalent to any other of the insignia in a set.

20. The method of playing a game of skill of claim 19, wherein the player designates his or her preferred insignia as wild.

21. The method of playing a game of skill of claim 20, wherein the step of awarding the player credit subsequent to stopping the sequential displaying of a set and designating one of the plurality of different insignia as wild, includes awarding a progressively increased amount of credits for fast response time for the player designating an insignia as wild and a progressively decreased amount of credits for a slow response time for designating an insignia as wild.

22. The method of playing a game of skill of claim 21, including providing a bonus game that is awarded upon the display of a designated set of indicia, wherein the chances of winning the bonus game is controlled entirely by chance and not based on the player's use of skill.

23. The method of playing a game of skill of claim 11, wherein the step of providing a set of a plurality of sets of insignia, includes providing sets in a matrix of at least two horizontal rows and at least two vertical rows, wherein one of the rows is designated as a win line, and wherein the step of awarding the player for stopping the sequential displaying of a set on a set displaying a winning pattern of indicia, includes the step of a player selecting at least one insignia for movement from a row onto the win line to obtain a winning combination of insignia.

24. The method of playing a game of skill of claim 23, wherein the step of awarding the player credits subsequent to stopping the sequential displaying of a set and the step of a player moving at least one insignia from a row other than the win row onto the win row, includes awarding a progressively increased amount of credits for fast response time for the player selecting at least one insignia for movement and a progressively decreased amount of credits for a slow response time for selecting at least one insignia for movement.

25. The method of playing a game of skill of claim 24, including providing a bonus game that is awarded upon the display of a designated set of indicia, wherein the chances of winning the bonus game is controlled entirely by chance and not based on the player's use of skill.

* * * * *